United States Patent [19]

Hegle

[11] Patent Number: 4,782,635

[45] Date of Patent: Nov. 8, 1988

[54] CONNECTOR FOR HANGING PANELS TO A BUILDING FRAME

[75] Inventor: Richard L. Hegle, Whittier, Calif.

[73] Assignee: Rockwin Corporation, Santa Fe Springs, Calif.

[21] Appl. No.: 75,085

[22] Filed: Jul. 20, 1987

[51] Int. Cl.[4] ..... E04H 1/00

[52] U.S. Cl. ..... 52/126.4; 52/235

[58] Field of Search ..... 52/235, 710, 126.3, 52/126.4, 511, 513

[56] References Cited

U.S. PATENT DOCUMENTS

| | | | |
|---|---|---|---|
| 3,913,287 | 10/1975 | Chapman, Jr. | 52/235 X |
| 4,194,333 | 3/1980 | Paton et al. | 52/235 |
| 4,625,481 | 12/1986 | Crandell | 52/235 |
| 4,662,135 | 5/1987 | Tanikawa et al. | 52/235 |
| 4,720,452 | 1/1988 | Fricker | 52/235 |

*Primary Examiner*—Carl D. Friedman

*Attorney, Agent, or Firm*—Dominick Nardelli

[57] ABSTRACT

There is taught the use of a steel angle section suitably fixed onto the inside surface of a panel. Each panel has at least one angle section mounted relatively near the upper end but can be mounted anywhere thereon. One leg of the angle section is disposed perpendicularly to the panel to form a flange. The depending of the flange has its outer surface preferably disposed flush with the surface of the panel. The panel is provided with an opening in the region behind the depending leg. In addition, the depending leg is provided with a vertical slot in which a key member is disposed to move vertically within the slot. To the key member is pivotably mounted a swing arm or tie plate which has an elongated slot at its other end. Through this slot at the other end, a pin is fitted to mount the tie plate to the building. Vertically disposed and threaded through the upper leg of the angle section is a bolt whose end bears on the key member to provide vertical adjustment.

7 Claims, 1 Drawing Sheet

CONNECTOR FOR HANGING PANELS TO A BUILDING FRAME

BACKGROUND OF THE INVENTION

1. Field of the Invention

This invention relates to a connector for hanging panels on the outside of a frame of a building and more particularly, to a hanger that is safe, simple and rugged but still allows vertical, horizontal and depth adjustments of the panel.

2. Description of the Prior Art

In the past most hangers for hanging panels on the outside of a building consisted of an arm pivotably mounted on a flat surface which was provided on the frame of the building. The arm being mounted on a vertical pin fixed to the flat surface was rotatable about the pin in an horizontal plane. The hole in the arm wherein the pin was disposed was elongated to give the "in-and-out" motion. The end of the arm removed from the pin had another vertical pin fixed thereto. The upper end of this other pin was threaded and had a nut threaded thereon. The panels were made with at least two spaced flanges located near the upper edge and each flange was provided with a circular opening so that when the panel was lifted and set in place the other vertical pin on the pivotable arm engages the respective opening in the flange. One can see that the nut on the threaded vertical pin provided "up-and-down" adjustment; that the pivotal motion provided horizontal adjustment and the slotted hole provided "in-and-out" adjustment.

Although this method works with relatively light, thin panels it still requires extensive, expensive field work and is relatively impractical on thick (say 4 inches or more), heavy panels.

SUMMARY OF THE INVENTION

1. Statement

In the preferred embodiment of the present invention, there is taught the use of a steel angle section suitably fixed onto the inside surface of a panel. Each panel has at least one angle section mounted relatively near the upper end but can be mounted anywhere thereon. One leg of the angle section is disposed perpendicularly to the panel for form a flange. The depending of the flange has its outer surface preferably disposed flush with the surface of the panel. The panel is provided with an opening in the region behind the depending leg. In addition, the depending leg is provided with a vertical slot in which a key member is disposed to move vertically within the slot. To the key member is pivotably mounted a swing arm or tie plate which has an elongated slot at its other end. Through this slot at the other end, a pin is fitted to mount the tie plate to the building. Vertically disposed and threaded through the upper leg of the angle section is a bolt whose end bears on the key member to provide vertical adjustment.

2. Objects

An object of this invention is to minimize panel blockout costs in the field;

Another object of this invention is to simplify embedding layout and installation of the panels;

Another object of this invention is to simplify rotational bracing;

Another object of this invention is to provide a hanger that does not interfere with steel fireproofing.

Another object of this invention is to provide a hanger that allows three-dimensional adjustment while maintaining positive engagement of the panel to the building frame.

Another object of this invention is to provide a panel hanger that allows quick attachment to the frame of a building.

Another object of this invention is to provide a hanger that may be used to connect building frame panels of various configurations.

DESCRIPTION OF THE PREFERRED EMBODIMENT

Figure 1:
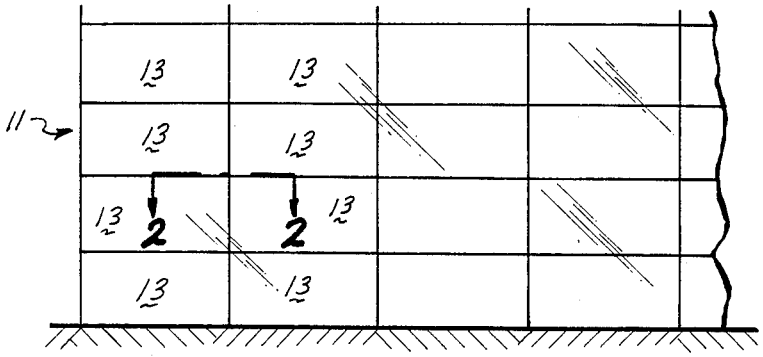
FIG. 1 is a small scale vertical, partial elevation of the outside wall of a building that can utilize the novel means disclosed herein.

Referring to FIG. 1, there is shown in small scale a partial elevation of a vertical outside wall 11 of a building 12. In this case the wall 11 is constructed of a plurality of identical panels 13 but panels 13 need not be identical but can be designed of various dimensions and have formed thereon relief designs that are pleasing to the eye. As is well known in the art, panels 13 are supported by a steel frame structure represented by item 21 in FIGS. 2, 3 and 4. Item 21 can be, for example, the building frame or support, any special structural member attached to the building frame, or any auxiliary support members.

Figure 3:
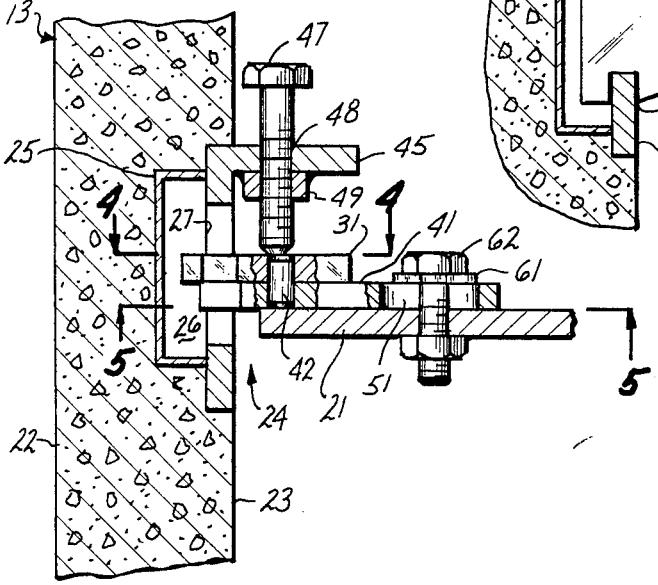
FIG. 3 is a sectional elevational view taken on line 3—3 of FIG. 2 in the direction of the arrows.
Figure 4:
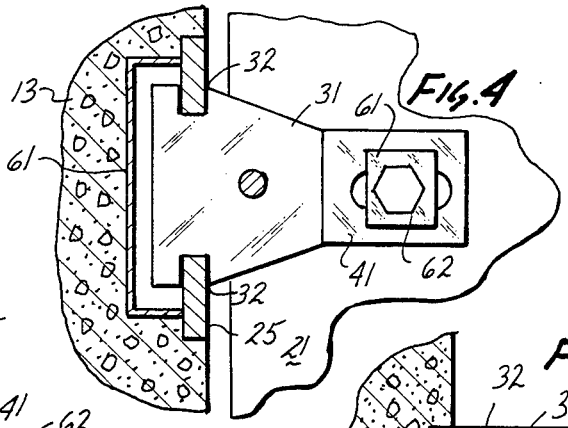
FIG. 4 is a sectional plan view taken on line 4—4 of FIG. 3 in the direction of the arrows.
Figure 5:
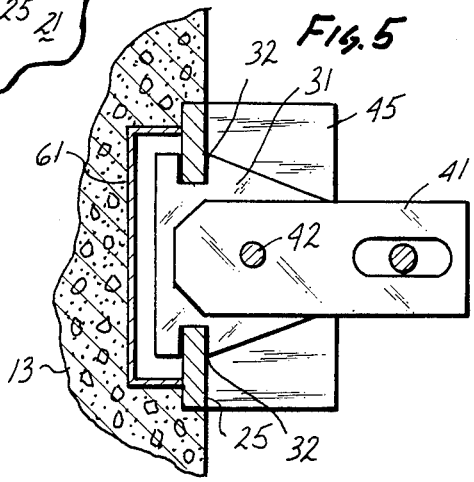
FIG. 5 is a plan view taken on line 5—5 of FIG. 5 in the direction of the arrows.
Figure 2:
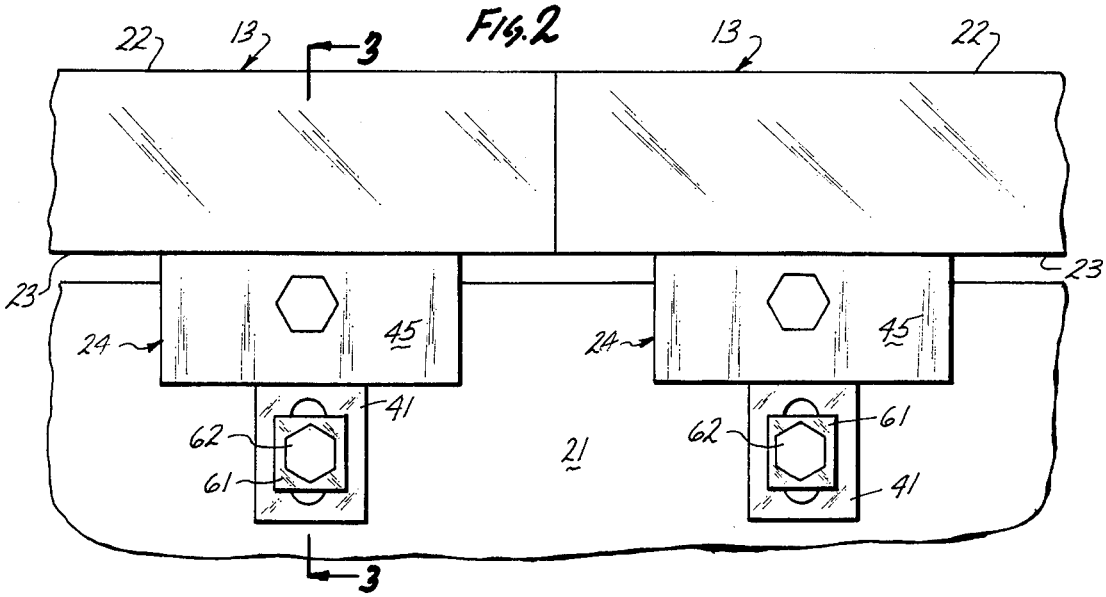
FIG. 2 is an enlarged plan view taken on line 2—2 of FIG. 1 in the direction of the arrows.

Referring to FIGS. 2, 3 and 4, item 13 as shown is a partial of panel 13 shown in FIG. 1. In this embodiment panel 13 is, for example, relatively thick, at least four inches, and is made of reinforced concrete. The panel 13 has an outside surface 22 that is substantially parallel to an inside surface 23. Imbedded in surface 23 is a steel angle section 24 which has its longer leg 25 imbedded so that the inside surface of leg 25 is flush with surface 23. Behind the leg 25 is provided a recess 26 whose function will become apparent hereinafter. Leg 25 is provided with an elongated opening 27, made preferably rectangular. Slideably disposed within opening 27 is a key member 31. As shown in FIGS. 4 and 5 key member 31 has two opposing slots 32, into which is disposed the respective vertical opposing edges of opening 27 in leg 25. To the underside of the key member 31 is pivotably mounted a swing arm 41 by a suitable pin 42 forming a vertical axle. The angle section 24 also has a shorter leg 45 protruding from and perpendicularly to surface 23 forming a flange extending from the panel 13, as shown. The leg 45 supports a bolt 47 threaded through a suitably threaded hole 48 formed therein. In some applications leg 45 is not of sufficient thickness to support a suitable number of threads and therefore one skilled in the art may provide a boss 49 to the underside of the leg 45 suitably welded thereto and formed with suitable threads. To finish describing the swing arm 41 one observes that, at the opposite end from pin 42, the arm 41 has an elongated slot 51 whose function will become apparent hereinafter. One can readily observe that the features described up to now can be assembled at the factory and not at the job sight.

PREFERRED INSTALLATION PROCEDURE

Normally to fully utilize the facilities at the place of manufacture, panels 13 are assembled with as much of the needed appendages as the design would allow. In this embodiment, the panels 13 are cast while in a horizontal position with all the required standard reinforcing bars (not shown) in place. In addition, each panel 13 is cast with at least one angle section 24 positioned as shown and described. To ensure that opening 26 is formed behind leg 25, one could weld a box-like structure 61 to leg 25, as shown.

While the respective panel is being cast, one assembles, by suitable means, the swing arm 41 to key member 31 by the pin 42 (as illustrated), so that the two pieces 31 and 41 pivot about pin 42.

After the respective panel 13 is cast and hardens, the key member 31 is installed within the opening 27 formed in the longer leg 25 of angle section 24. In this embodiment the installation is performed by canting the key member 31 with respect to the opening 27 and when the opposing slots 32 are aligned with the vertical edges of opening 27 in leg 25 the key member is twisted to its horizontal position as shown in the drawing. Then the bolt 47 is threaded into the threaded hole 48 in leg 45 of angle section 24, so that the bolt 47 bears down on the swing arm 41 which, in turn, bears down on the lower peripheral edge of opening 27 (which position is not shown) whereby the swing arm 41 and key member 31 are locked into position on panel 13.

The panels 13 are delivered to the job site and lifted into their respective vertical positions on the steel frame structure 21. When the respective panel 13 is almost in its correct position, one finds or locates a suitable hole in the structure 21 so that a bolt 62 which also functions as a vertical axle can be inserted therethrough and also through the elongated slot 51 that has been formed in the swing arm 41. Of course one would prefer to use a washer 61 and a nut to fix the bolt 62 in place.

After bolt 62 is practically secured wherein swing arm 41 can still slide on structure 21 without any appreciable lifting therefrom, one can move the respective panel 13 "in-and-out" because elongated slot 51 allows for this function. The panel 13 can also be moved sideways "left-and-right" because pin 42 allows pivotal motion between key member 31 and swing arm 41. After the panel 13 is in its correct "in-and-out" position and "left-and-right" position, bolt 62 is secured in place by tightening the bolt thereon. To ensure complete rigidity, after being thus secured key member 31, swing arm 41, and the frame 21 are welded together.

To adjust the "up-and-down" position one obviously uses bolt 47 to provide this adjustment. Preferably to insure completely the "up-and-down" adjustment one could loosen bolt 47 on the job sight so that key member 31 is spaced from both the top and the bottom of opening 27.

I claim:

1. A connector for hanging a panel with opposing substantially parallel surfaces to a building frame having an horizontally disposed flat surface, said connector comprising:

first means on said panel having an adjustment means to provide vertical "up-and-down" adjustment between said panel and said building frame;

second means slidably connected to said first means and capable of being mounted to said horizontal flat surface to provide "in-and-out" adjustment, and "left-and-right" adjustment; and in co-operation with said first means to provide said "up-and-down" adjustment; and said second means having a pair of pivotally connected members and having an axle so that said second means is capable of being rotated about said axle with respect to said flat surface.

2. The connector of claim 1 wherein said first means comprises at least one flange disposed on and perpendicular to one of said parallel surfaces of said panel; and a threaded bolt threaded into said flange 1.

3. The connector of claim 1 wherein said first means comprises:

at least one flange protruding from one of said parallel surfaces of said panel;

a threaded bolt threaded into said flange;

said one surface having a recess formed adjacent said flange, and;

said second means being capable of co-operating with said recess to provide said "up-and-down" adjustment.

4. The connector of claim 3 wherein said second means comprises:

a key member co-operating with said recess so that said key member is capable of moving up-and-down on a line and of being restricted in motion in the direction perpendicular to said line;

a swing arm capable of being fixed to said horizontal surface on said building frame;

said key member and said swing arm being disposed to rotate with respect to each other.

5. The connector of claim 1 wherein said first means comprises:

a 90° angle section having first and second legs disposed perpendicular to each other, each of said legs have first and second surfaces wherein the respective first surfaces of each of said legs form the 90° angle and the respective second surfaces of each of said legs form the 270° angle;

said angle section being disposed with respect to said panel so that the first surface of said first leg is co-planar with one of said parallel surfaces on said panel;

said panel having a recess disposed adjacent said first leg;

said first leg having an opening with two opposing parallel edges formed therein disposed so that its two opposing parallel edges are perpendicular to said second leg.

6. The connector of claim 5 wherein said second means comprises:

a key member co-operating with said recess so that said key member is capable of moving up-and-down along said parallel edges;

a swing arm capable of being rotatably disposed on and fixed to said horizontal surface on said building frame;

said key member and said swing arm being disposed to rotate with respect to each other.

7. The connector of claim 6 wherein:

said first leg includes a threaded hole;

a bolt threaded through said threaded hole and capable of bearing against said key member.

* * * * *